US007585451B2

(12) United States Patent
Bryner et al.

(10) Patent No.: US 7,585,451 B2
(45) **Date of Patent: *Sep. 8, 2009**

(54) ELECTROBLOWING WEB FORMATION PROCESS

(75) Inventors: Michael Allen Bryner, Midlothian, VA (US); Jack Eugene Armantrout, Richmond, VA (US); John Edward Armstrong, Newark, DE (US); Benjamin Scott Johnson, Rocky Mount, NC (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 594 days.

This patent is subject to a terminal disclaimer.

(21) Appl. No.: 11/023,068

(22) Filed: Dec. 27, 2004

(65) Prior Publication Data

US 2006/0138711 A1 Jun. 29, 2006

(51) Int. Cl.
*H05B 7/00* (2006.01)

(52) U.S. Cl. ..... 264/465

(58) Field of Classification Search ..... 264/465, 264/10, 413, 433, 441, 454
See application file for complete search history.

(56) References Cited

U.S. PATENT DOCUMENTS 3,319,309 A * 5/1967 Owens ..... 19/29
3,387,326 A * 6/1968 Hollberg et al. ..... 425/72.2
5,227,172 A * 7/1993 Deeds ..... 425/72.2
5,296,172 A * 3/1994 Davis et al. ..... 264/441
5,498,463 A * 3/1996 McDowall et al. ..... 428/198
2002/0089094 A1* 7/2002 Kleinmeyer et al. ..... 264/465
2004/0094873 A1 5/2004 Dubson et al.
2007/0042069 A1 2/2007 Armantrout et al.

FOREIGN PATENT DOCUMENTS

FR 1 792 656 10/2000
WO WO 89/09298 10/1989
WO WO 03/080905 A1 * 10/2003
WO WO 03/090805 A1 10/2003

OTHER PUBLICATIONS

Jayesh Doshi, Electrospinning Process and Applications of Electrospun Fibers, Journal of Electrostatics,vol. 35,1995, pp. 151-160.*

Zheng-Ming Huang, Y.-Z. Zhang, M. Kotaki, S. Ramakrishna, A review on polymer nanofibers by electrospinning and their applications in nanocomposites, Composites Science and Technology, 2003, pp. 2223-2253, 63, Elsevier Ltd.

* cited by examiner

*Primary Examiner*—Leo B Tentoni

(57) ABSTRACT

An improved electroblowing process is provided for forming a fibrous web of nanofibers wherein polymer stream is issued from a spinning nozzle in a spinneret with the aid of a forwarding gas stream, passes an electrode and a resulting nanofiber web is collected on a collector. The process includes applying a high voltage to the spinneret and grounding the electrode such that an electric field is generated between the spinneret and the electrode of sufficient strength to impart an electrical charge on the polymer as it issues from the spinning nozzle.

11 Claims, 2 Drawing Sheets

ELECTROBLOWING WEB FORMATION PROCESS

FIELD OF THE INVENTION

The present invention relates to a process for forming a fibrous web wherein a polymer stream is spun through a spinning nozzle into an electric field of sufficient strength to impart electrical charge on the polymer and wherein a forwarding gas stream aids in transporting the polymer away from the spinning nozzle.

BACKGROUND OF THE INVENTION

PCT publication no. WO 03/080905A discloses an apparatus and method for producing a nanofiber web. The method comprises feeding a polymer solution to a spinning nozzle to which a high voltage is applied while compressed gas is used to envelop the polymer solution in a forwarding gas stream as it exits the nozzle, and collecting the resulting nanofiber web on a grounded suction collector.

There are several disadvantages to the process disclosed in PCT publication no. WO 03/080905A, particularly if the process is carried out on a commercial scale.

One disadvantage of the prior art is the necessity of using a quite high voltage. In order to impart electrical charge on the polymer, an electrical field of sufficient strength is needed. Due to the distances involved between the spinning nozzle and the collector, high voltage is used to maintain the electric field. An object of this invention is to lower the voltage used.

Still another disadvantage of the prior art is the coupling of the spinning nozzle to collector distance to the voltage used. During operation of the prior art process, it may be desirable to change the distance of the spinning nozzle to the collector. However, by changing that distance the electric field generated between the spinning nozzle and the collector changes. This requires changing the voltage in order to maintain the same electric field. Another objective of this invention is to decouple the spinning nozzle to collector distance from the electric field.

SUMMARY OF THE INVENTION

A first embodiment of the present invention is directed to an electroblowing process for forming a fibrous web comprising issuing an electrically charged polymer stream from a spinning nozzle in a spinneret, passing the polymer stream by an electrode which is substantially grounded, wherein a voltage is applied to the spinneret such that an electric field is generated between the spinneret and the electrode of sufficient strength to impart said electrical charge to the polymer stream as it issues from the spinning nozzle, and collecting nanofibers formed from the charged polymer stream on a collector as a fibrous web.

DEFINITIONS

The terms "electroblowing" and "electro-blown spinning" herein refer interchangeably to a process for forming a fibrous web by which a forwarding gas stream is directed generally towards a collector, into which gas stream a polymer stream is injected from a spinning nozzle, thereby forming a fibrous web which is collected on the collector, wherein a voltage differential is maintained between the spinning nozzle and an electrode and the voltage differential is of sufficient strength to impart charge on the polymer as it issues from the spinning nozzle.

The term "nanofibers" refers to fibers having diameters of less than 1,000 nanometers.

DETAILED DESCRIPTION OF THE INVENTION

Figure 1:
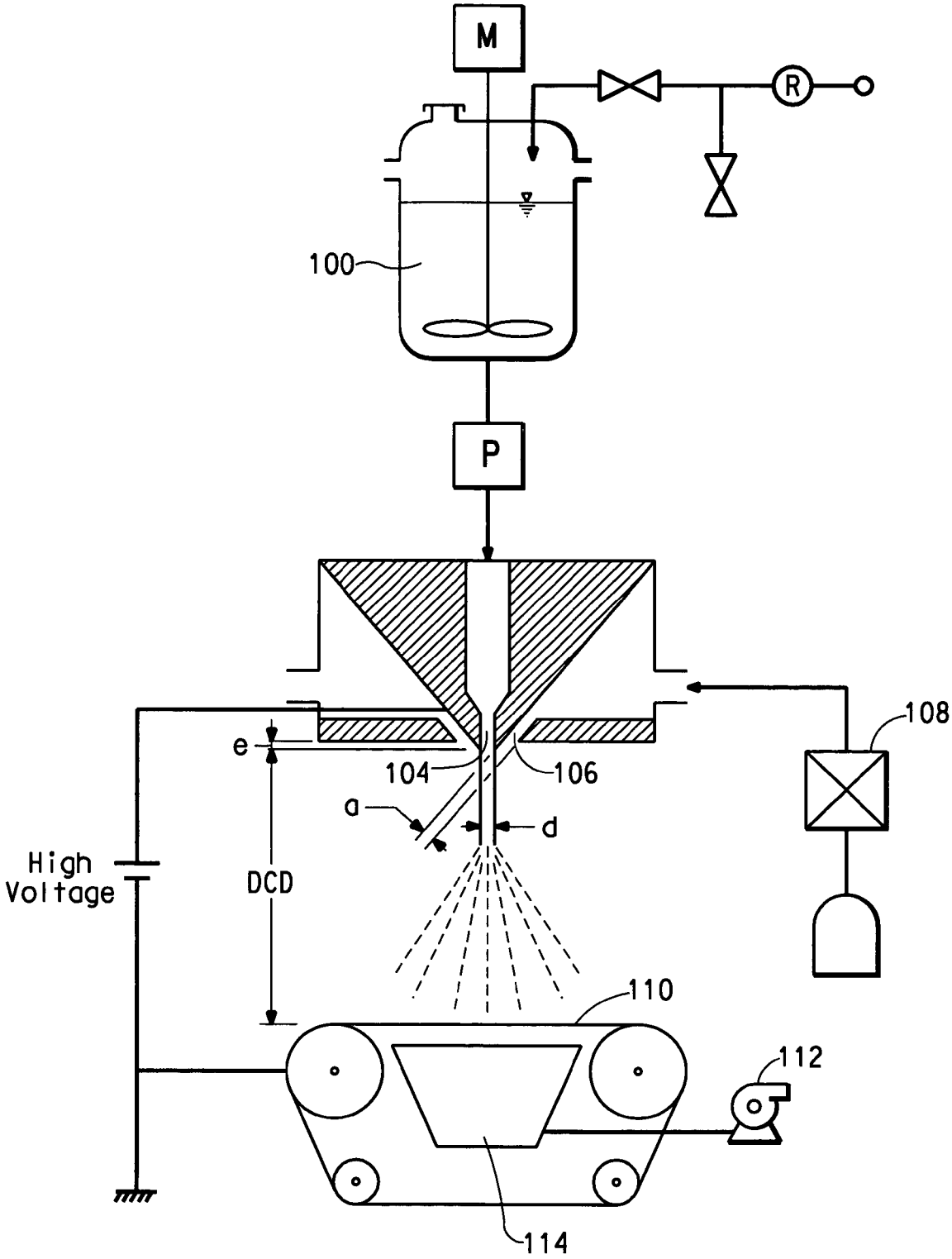
FIG. 1 (Prior Art)
FIG. 1 is an illustration of the prior art electroblowing apparatus.

Reference will now be made in detail to the presently preferred embodiments of the invention, examples of which are illustrated in the accompanying drawings. Throughout the drawings, like reference characters are used to designate like elements.

An electroblowing process for forming fibrous web is disclosed in PCT publication number WO 03/080905A (FIG. 1), corresponding to U.S. Ser. No. 10/477,882, filed Nov. 19, 2003, the contents of which are hereby incorporated by reference. There are disadvantages to this process, as already described above.

Figure 2:
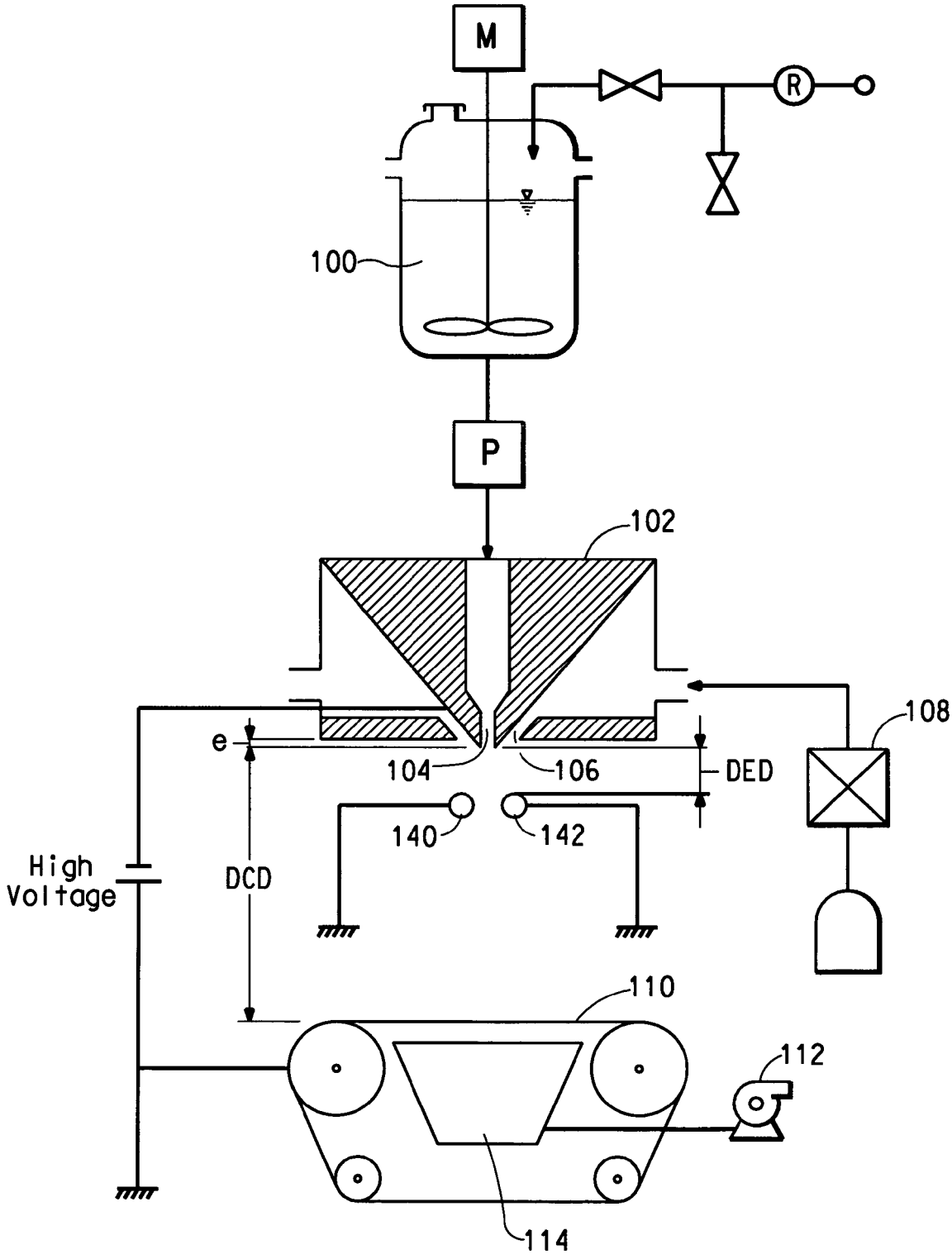
FIG. 2 is a schematic of a process and apparatus according to the present invention.

In the process of the present invention, referring to FIG. 2, according to one embodiment of the invention, a polymer stream comprising a polymer and a solvent, or a polymer melt, is fed from a storage tank, or in the case of a polymer melt from an extruder 100 to a spinning nozzle 104 (also referred to as a "die") located in a spinneret 102 through which the polymer stream is discharged. The polymer stream passes through an electric field generated between spinneret 102 and electrodes 140 and 142 as it is discharged from the spinneret 102. Compressed gas, which may optionally be heated or cooled in a gas temperature controller 108, is issued from gas nozzles 106 disposed adjacent to or peripherally to the spinning nozzle 104. The gas is directed generally in the direction of the polymer stream flow, in a forwarding gas stream which forwards the newly issued polymer stream and aids in the formation of the fibrous web.

While not wishing to be bound by theory, it is believed that the forwarding gas stream provides the majority of the forwarding forces in the initial stages of drawing of the fibers from the issued polymer stream and in the case of polymer solution, simultaneously strips away the mass boundary layer along the individual fiber surface thereby greatly increasing the diffusion rate of solvent from the polymer solution in the form of gas during the formation of the fibrous web.

At some point, the local electric field around polymer stream is of sufficient strength that the electrical force becomes the dominant drawing force which ultimately draws individual fibers from the polymer stream to diameters measured in the hundreds of nanometers or less.

It is believed that the angular geometry of the tip of the spinning nozzle 104, also referred to as the "die tip," creates an intense electric field in the three-dimensional space surrounding the tip which causes charge to be imparted to the polymer stream. The die tip may be in the form of a capillary of any desired cross-sectional shape, or in the form of a linear array of such capillaries. In the embodiment in which the die tip is an angular beam containing a linear capillary array of spinning nozzles, the forwarding gas stream is issued from gas nozzles 106 on each side of the spinneret 102. The gas nozzles are in the form of slots formed between elongated knife edges, one on each side of the spinneret 102, along the length of the linear capillary array, and the spinneret 102. Alternately, in the embodiment in which the die tip is in the form of a single capillary, the gas nozzle 106 may be in the form of a circumferential slot surrounding the spinneret 102. The gas nozzles 106 are directed toward the spinning nozzle, generally in the direction of the polymer stream flow. The angular die tip, and therefore the spinning nozzle(s), is positioned such that it extends beyond the end of the spinneret and gas nozzles a distance "e" (FIG. 2). It is believed that the electric field combined with the charge on the polymer stream provides spreading forces which act on the fibers and fibrils formed therein, causing the web to be better dispersed and providing for very uniform web laydown on the collection surface of the collector.

Advantageously, the polymer solution is electrically conductive. Examples of polymers for use in the invention may include polyimide, nylon, polyaramide, polybenzimidazole, polyetherimide, polyacrylonitrile, PET (polyethylene terephthalate), polypropylene, polyaniline, polyethylene oxide, PEN (polyethylene naphthalate), PBT (polybutylene terephthalate), SBR (styrene butadiene rubber), polystyrene, PVC (polyvinyl chloride), polyvinyl alcohol, PVDF (polyvinylidene fluoride), polyvinyl butylene and copolymer or derivative compounds thereof. The polymer solution is prepared by selecting a solvent suitable to dissolve the polymer. The polymer solution can be mixed with additives including any resin compatible with an associated polymer, plasticizer, ultraviolet ray stabilizer, crosslink agent, curing agent, reaction initiator, electrical dopant, etc. Any polymer solution known to be suitable for use in a conventional electrospinning process may be used in the process of the invention.

In another embodiment of the invention, the polymer stream fed to the spin pack and discharged through the nozzle in the spinneret is a polymer melt. Any polymer known to be suitable for use in a melt electrospinning process may be used in the process in the form of a polymer melt.

Polymer melts and polymer-solvent combinations suitable for use in the process are disclosed in Z. M. Huang et al., Composites Science and Technology, volume 63 (2003), pages 2226-2230, which is herein incorporated by reference.

Advantageously, the polymer discharge pressure is in the range of about 0.01 kg/cm$^2$ to about 200 kg/cm$^2$, more advantageously in the range of about 0.1 kg/cm$^2$ to about 20 kg/cm$^2$, and the polymer stream throughput per hole is in the range of about 0.1 cc/min to about 15 cc/min.

The velocity of the compressed gas issued from gas nozzles 106 is advantageously between about 10 and about 20,000 m/min, and more advantageously between about 100 and about 3,000 m/min.

After the polymer stream exits the spinning nozzle 104 it passes by electrodes 140 and 142, as shown in FIG. 2. These electrodes can be combined into one unit as a ring-shaped electrode or kept separate as bars. Whereas a ring-shaped electrode can be used for one or more spinning nozzles, bar electrodes extending substantially the entire length of the spinning beam and/or the capillary array, can be used for a beam containing a linear array of spinning nozzles. The distance between the spinning nozzle and the electrode (also referred to as the "die to electrode distance" or "DED") is in the range of about 0.01 to about 100 cm, and more advantageously in the range of about 0.1 to about 25 cm. The electrode can also be placed between the spinning nozzle and the spinneret within a distance "e" (FIG. 2), wherein the distance from the spinning nozzle to the collector is less than the distance from the electrode to the collector. However, this embodiment provides a less effective electric field than the embodiment of having the electrode located after spinning nozzle. By applying the voltage to the spinneret, the electrode may be grounded or substantially grounded. By "substantially grounded" is meant that the electrode preferentially may be held at a low voltage level, i.e., between about −100 V and about +100 V. However, it is also understood that the electrode can have a significant voltage provided the spinneret has a voltage that maintains the desired voltage differential between the electrode and the spinneret. This voltage differential can have a positive or negative polarity with respect to the ground potential. In one embodiment, the spinneret and the electrode can have the same voltage but with different polarities. The voltage differential between the electrode and the spinneret is in the range of about 1 to about 100 kV, and even in the range of about 2 to about 50 kV, and even as low as about 2 to about 30 kV. The process of the invention allows for the use of lower voltage due to a shorter distance between the spinneret and the electrode versus a longer distance between the spinneret and the collector as described above.

Located a distance below the spinneret 102 is a collector for collecting the fibrous web produced. In FIG. 2, the collector comprises a moving belt 110 onto which the fibrous web is collected, and can include a porous fibrous scrim which is moving on said moving belt, onto which the fibrous web formed by the present process is deposited. The belt 110 is advantageously made from a porous material such as a metal screen so that a vacuum can be drawn from beneath the belt through vacuum chamber 114 from the inlet of blower 112. In this embodiment of the invention, the collection belt is grounded. The collected fibrous web of nanofibers is sent to a wind-up roll, not shown.

It has been found that the distance between the spinneret and the collection surface (also referred to as the "die to collector distance" or "DCD"; illustrated in FIG. 2) is in the range of about 1 to about 200 cm, and more advantageously in the range of about 10 to about 50 cm.

It has further been found that when the tip of the spinning nozzle or die tip protrudes from the spinneret by a distance e (FIG. 2), such that the distance between the nozzle and the collection surface is less than the distance between the spinneret and the collection surface, a more uniform electric field results. Not wishing to be bound by theory, it is believed that this is because the protruding nozzle establishes a sharp edge or point in space which concentrates the electric field.

EXAMPLES

Example 1

Poly(ethylene oxide) (PEO), viscosity average molecular weight (Mv) ~300,000, available from Sigma-Aldrich, St Louis, Mo. is dissolved in deionized water to make a 10% by weight PEO solution. The solution electrical conductivity is measured to be 47 Micro-Siemens/cm using a VWR digital conductivity meter available from VWR Scientific Products (VWR International, Inc., West Chester, Pa.). The solution is spun in a single orifice electroblowing apparatus comprising a 26 gauge blunt syringe needle, in a concentric forwarding air jet. The needle tip protrudes 2.5 mm below the conductive face of the spin pack body. A high voltage is applied to the spin pack body and the spin orifice. The PEO solution is directed through a ring-shaped electrode, which is electrically grounded through an ammeter. Suitable process conditions are in the Table, below.

PEO fibers are formed via this process and are collected on a conductive surface and examined under a scanning electron microscope. Nanofibers are collected having fiber diameters ranging from about 100 to about 700 nanometers.

Example 2

The procedure of Example 1 is followed except with a smaller inside diameter electrode, with the electrode located closer to the die tip and with a lower voltage applied to the spinneret. Suitable process conditions are listed in the Table, below. Nanofibers are collected having fiber diameters ranging from about 100 to about 700 nanometers.

The procedure of Example 2 shows that by decreasing the electrode inside diameter and decreasing the DED, the applied voltage to the spinneret can be reduced and still generate similar sized fibers as Example 1.

Example 3

The procedure of Example 2 is repeated except with a slightly higher voltage on the spinneret. Suitable process conditions are listed in the Table, below. Nanofibers are collected having fiber diameters ranging from about 100 to about 700 nanometers.

TABLE

| Spinning Conditions | Ex. 1 | Ex. 2 | Ex. 3 |
|---|---|---|---|
| Throughput (mL/min) | 0.5 | 0.5 | 0.5 |
| Volumetric Airflow (L/min) | 24.5 | 24.5 | 24.5 |
| Air Flow Velocity (m/s) | 12 | 12 | 12 |
| Electrode Inside Diameter (mm) | 28.2 | 22.9 | 22.9 |
| Die to Electrode Distance (mm) | 25.4 | 12.7 | 12.7 |
| Polarity | negative | negative | negative |
| Voltage (kV) | 30 | 14 | 16 |
| Die to Collector Distance (cm) | 30 | 30 | 30 |

Comparative Example

A procedure was followed in accordance with PCT publication number WO 03/080905A. The procedure included a 0.1 meter spin pack with no electrode present. A high voltage of −60 kV was applied to the spinneret and the collector was grounded.

A 22% by weight solution of nylon 6 (type BS400N obtained from BASF Corporation, Mount Olive, N.J.) in formic acid (obtained from Kemira Industrial Chemicals, Helsinki, Finland) was electroblown through a spinneret of 100 mm wide, having 11 nozzles at a throughput rate of 1.5 cc/hole. A forwarding air stream was introduced through air nozzles at a flow rate of 4 scfm (2 liters per second). The air was heated to about 70° C. The distance from the spinneret to the upper surface of the collector was approximately 300 mm. The process ran for about 1 minute.

Nineteen fibers from the product collected were measured for fiber diameter. The average fiber size was 390 nm with a standard deviation of 85.

Examples 1-3 demonstrate that the use of an electrode positioned and charged in accordance with the present invention requires less voltage than the method of the prior art to produce nanofibers with similar fiber diameters.

What is claimed is:

1. An electroblowing process for forming a fibrous web comprising:

(a) issuing an electrically charged polymer stream from a spinning nozzle in a spinneret;

(b) passing the polymer stream by an electrode which is grounded, wherein a voltage is applied to the spinneret such that an electric field is generated between the spinneret and the electrode of sufficient strength to impart said electrical charge to the polymer stream as it issues from the spinning nozzle; and (c) collecting nanofibers formed from the charged polymer stream on a collector as a fibrous web.

2. The process of claim 1 wherein the polymer stream is a stream of polymer solution.

3. The process of claim 1 wherein the polymer stream is a stream of molten polymer.

4. The process of claim 1 wherein the polymer stream is electrically conductive.

5. The process of claim 1 wherein the collector is substantially grounded.

6. The process of claim 1 wherein a voltage differential between the spinneret and the electrode is in the range of about 1 to about 100 kV.

7. The process of claim 6 wherein the voltage differential between the spinneret and the electrode is in the range of about 2 to about 50 kV.

8. The process of claim 1 wherein the polymer stream is negatively charged.

9. The process of claim 1, wherein the polymer stream is positively charged.

10. The process of claim 1, wherein the polymer stream exits the spinning nozzle at a throughput per hole in the range of about 0.1 cc/min to about 15 cc/min.

11. The process of claim 1, wherein the electrode is positioned a distance of between about 0.01 cm to about 100 cm from the exit of the spinning nozzle.

* * * * *